United States Patent [19]

Berger et al.

[11] Patent Number: 4,915,281

[45] Date of Patent: Apr. 10, 1990

[54] ARRANGEMENT FOR A METHOD OF CONVERTING A STEPWISE TRANSLATION MOVEMENT INTO A CONTINUOUS TRANSLATION MOVEMENT

[75] Inventors: Bernd Berger, Karl-Marx-Stadt; Matthias Schlieder, Oederan; Siegfried Stowasser, Falkenau, all of German Democratic Rep.

[73] Assignee: Bauakademie Der DDR, Berlin, German Democratic Rep.

[21] Appl. No.: 226,404

[22] Filed: Jul. 29, 1988

Related U.S. Application Data

[63] Continuation-in-part of Ser. No. 176,883, Apr. 4, 1988, abandoned.

[30] Foreign Application Priority Data

Apr. 3, 1987 [DE] Fed. Rep. of Germany ..... 3810966
Apr. 3, 1987 [DD] German Democratic Rep. ... 301482

[51] Int. Cl.[4] ..... B65H 20/24

[52] U.S. Cl. ..... 226/112; 91/189 R; 91/358 R; 91/361; 91/530; 198/468.2

[58] Field of Search ..... 91/358 R, 361, 362, 91/530, 36, 170 R, 171; 198/468.9, 468.11, 468.2, 859; 414/749; 226/112

[56] References Cited

U.S. PATENT DOCUMENTS

| | | | |
|---|---|---|---|
| 3,234,882 | 2/1966 | Douglas et al. | 91/189 |
| 4,593,884 | 6/1986 | Zschocke et al. | 226/112 |
| 4,625,622 | 12/1986 | Gunda et al. | 91/36 |
| 4,757,745 | 7/1988 | Taplin | 91/361 |
| 4,796,748 | 1/1989 | Manning | 198/859 |

*Primary Examiner*—Edward K. Look
*Assistant Examiner*—John Ryznic
*Attorney, Agent, or Firm*—Michael J. Striker

[57] ABSTRACT

For converting a stepwise translation movement into a continuous translation movement and arrangement and a method is provided which have at least two fluid-operated cylinder-piston units with cylinders are rigidly mechanically connected with one another and pistons movable in the cylinders between end positions and having piston rods, removably arranging clamping mechanisms on the pistons of the cylinder-piston units, arranging end position sensors in the regions of the end positions of the piston of a respective one of the cylinder-piston units, arranging end position pre-signal sensors so that they are axially spaced relative to the end position sensors, connecting the sensors with electronic a control unit, and producing by the electronic control unit signals for supplying a working fluid to the cylinders of the cylinder-piston units in an alternating manner.

10 Claims, 4 Drawing Sheets

ARRANGEMENT FOR A METHOD OF CONVERTING A STEPWISE TRANSLATION MOVEMENT INTO A CONTINUOUS TRANSLATION MOVEMENT

CROSS-REFERENCE TO RELATED APPLICATION

This application is a continuation-in-part of U.S. patent application Ser. No. 176,883, filed on Apr. 4, 1988 now abandoned.

BACKGROUND OF THE INVENTION

The present invention relates to an arrangement for and a method of converting a stepwise translation movement into continuous translation movement with the use of hydraulically or pneumatically controlled horizontal and vertical stepping displacement devices.

Arrangements and methods of the above-mentioned general type are known in the art. In a known hydraulic stepping displacement arrangement two parallel operating partial systems perform simultaneously both an unload stroke and a load stroke. The alternation of the unload stroke and load stroke is performed upon reaching of an end position of the displacement pistons by switching the respective magnetic valves directly through the associated end switch, inductive transducer and the like.

The disadvantage of this solution is that both partial systems are controlled independently of one another, and as a result of the faulty synchronization of a time offset of both partial systems occurs, which builds so that after several strokes both partial systems operate opposite to one another so that a rearward movement form is produced. This movement form poses a danger during transportation of objects with unfavorable position of the point of gravity. During constant accelerations and braking of the load, the transportation process becomes unfavorable in the sense of energy consumption and therefore not economical.

SUMMARY OF THE INVENTION

Accordingly, it is an object of the present invention to provide a simple, robust and flexible arrangement and a method which allows to control hydraulic and pneumatic stepping displacement devices so that a continuous movement along a common displacement path can be achieved.

In keeping with these objects, in accordance with the present invention, the displacement movements of the partial systems of hydraulic or pneumatic stepping displacement devices are synchronized and a jointless successive connection of two successively following working strokes of the displacement devices with parallel running load and unload strokes is provided.

In keeping with these objects and with others which will become apparent hereinafter, one feature of the present invention resides, briefly stated, in an arrangement which has two groups of or two hydraulically or pneumatically operated cylinder-piston units in which the cylinders are mechanically connected with one another while the pistons reciprocate in the cylinders and have piston rods with piston rod heads releasably connected with clamping mechanisms, end position sensors and axially offset end position pre-signal sensors arranged in the end regions of the piston strokes, and the signals are supplied by the end position sensors for processing in an electronic control device which produce in turn, the signals for controlling hydraulic or pneumatic direction valves operating for activating the pistons of the cylinder-piston units.

Another feature of the present invention is a method in accordance with which shortly before reaching the end positions of the pistons of the parallel operating cylinder-piston units, electrical pulses are supplied by means of position sensors, electronic transducers, etc. and processed in an electronic control device so that first a piston which displaces without load or idle and reach the end position is stopped in this position until a piston which displaces under load activates a presignal before reaching its end position, whereby immediately or with delay the piston which is located in immovable position is set in movement for a next working stroke, and a locking step can be performed. When this piston reaches the presignal of the previous end position, the other piston which can maintain further the previous movement direction is switched to a new unload stroke, and an unlocking process is interposed. The same process takes place during reaching of the upper end position.

The inventive arrangement and method provide for the advantage in that by the continuous translation movement considerable energy saving is achieved and the transportation of the loads with highest safety is guaranteed. The operation of one or several arrangements can be performed by a manual control or a completely automatic control.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
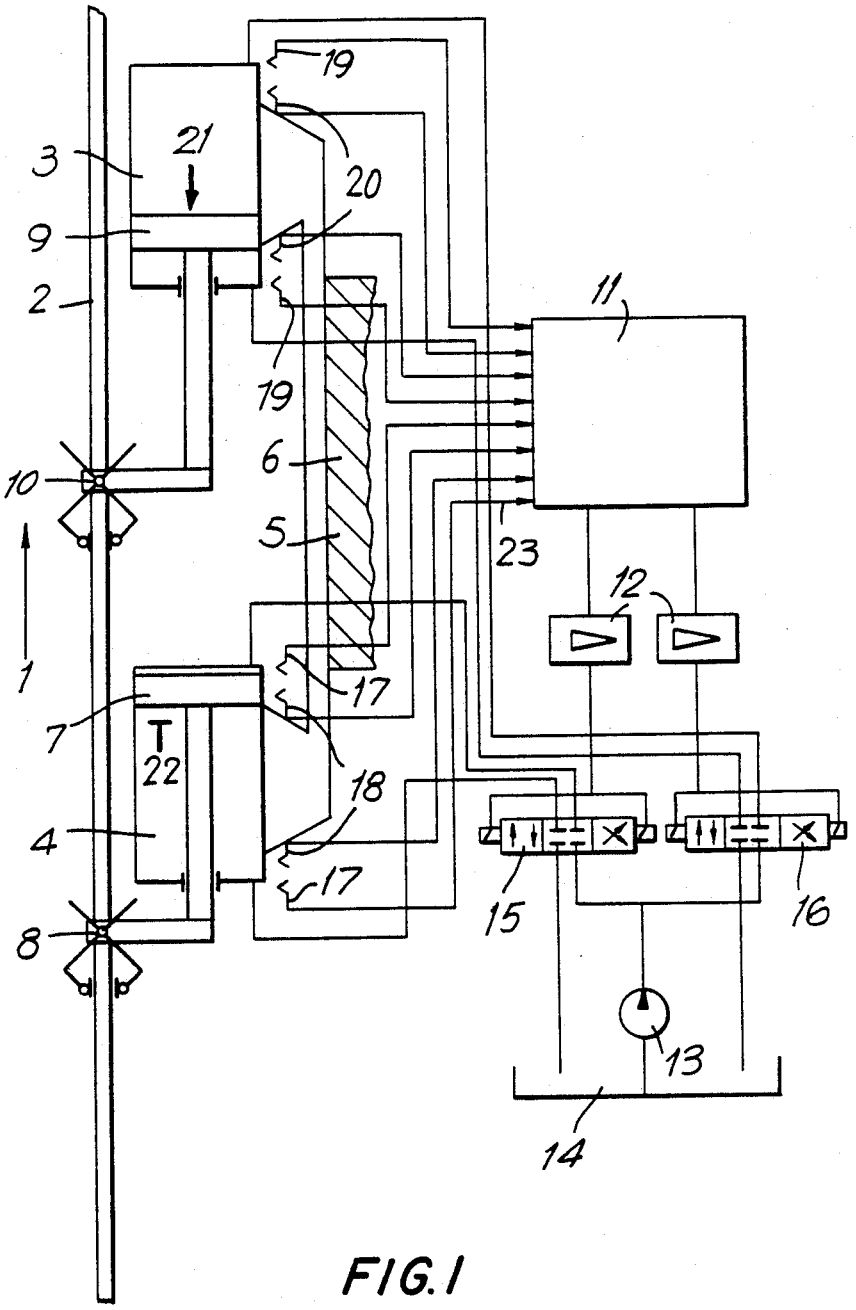
FIG. 1 is a view schematically showing an arrangement for converting a stepwise translation movement into a continuous translation movement in accordance with the present invention.

An arrangement for converting a stepwise translation movement into a continuous translation movement has two hydraulically or pneumatically operated displacement cylinder-piston units. The cylinder-piston units have cylinders which are identified with reference numerals 3 and 4 and rigidly mechanically connected with one another by a traverse 5. The traverse 5 can advantageously be formed as receiving a load 6. The cylinder-piston units have pistons 7 and 9 provided with respective piston rods. The heads of the piston rods of the pistons 7 and 9 are provided with clamping mechanisms 8 and 10 respectively. The clamping mechanisms 8 and 10 engage with a load receiving element 2, depending on a working position of the pistons.

Instead of the clamping mechanisms 8 and 10 and the loading receiving element 2, other forms of temporary connections with environment can be used, such as for example a connection of a vacuum cleaner to a wall or a floor. Furthermore, there is also a possibility in the event when the floor which forms a traveling track or a sliding track for the load receiving element 2, to provide a temporary force-transmitting connection with the load receiving element 2 under the action of the weight of the load 6 to be moved, instead of the clamping mechanisms 8 and 10. When the load receiving element in the case of a vertical translation movement is a rod or a rope, it can be guided in a respective tubular piston rod through the inventive arrangement.

For providing an inner and an outer position determination of the piston 9 of the cylinder 3 of the first cylinder-piston unit, the arrangement comprises end position sensors 19 and an end position pre-signal sensors 20 which are offset in an axial direction relative to end position sensor 19. For providing an inner and an outer position determination of the piston 7 of the cylinder 4 of the second cylinder-piston unit, the arrangement comprises end position sensors 17 and end position pre-signal sensors 18 which are offset in an axial direction relative to the end position sensors 17.

The sensors are connected with an electronic control device 11 through signal conduits 23. A respective working fluid is accommodated in a container 14 and supplied from it by a pump 13 and directional valves 15 and 16 through fluid conduits 24 to the cylinders 3 and 4 of the cylinder-piston units. The electronic control device 11 is connected with the fluid control through an amplifier 12.

The arrangement in accordance with the present invention is operated and the method in accordance with the present invention is performed for converting a stepwise translation movement into a continuous translation movement in that both mechanically coupled cylinder-piston units perform operations which are parallel in time. When the piston of the cylinder-piston units whose clamping mechanism arranged on the piston rod head engages with the load receiving element 2 performs a load stroke, the piston of the other cylinder-piston unit performs an unload stroke, and the unload stroke is performed faster than the load stroke.

The signals of the end position pre-signal sensors and the end position sensors released by the movement condition of the piston in the cylinder of the cylinder-piston unit, are supplied to the electronic control device 11 and processe so that the piston which performs an unload stroke reaches an end position and remains in it until the other piston which performs a load stroke reaches the end position pre-signal sensor of its desired end position. The clamping mechanism of the piston which is retained immovable is brought in engagement with the load receiving element 2 and set in movement for a new load stroke, while for the piston which performed the load stroke the clamping mechanism is released upon reaching the end position sensor. The movement direction of the piston for an unload stroke is reversed at the moment when the piston which performs the new load stroke passes the end position pre-signal sensor of the previous end position.

In FIG. 1 the piston 7 of the cylinder 4 of the second cylinder-piston unit reaches the end position which is indicated by the sensor 17 and activates its immovable position 22 through the electronic control device 11 and the directional valve 15. The clamping mechanism 8 is not in engagement with the load receiving element 2. The piston 9 of the piston 3 of the first displacement cylinder-piston unit is located in a movement direction 21 under load and does not reach the end position pre-signal sensor 20, while the clamping mechanism 10 is in engagement with the load receiving element 2.

Figure 2:
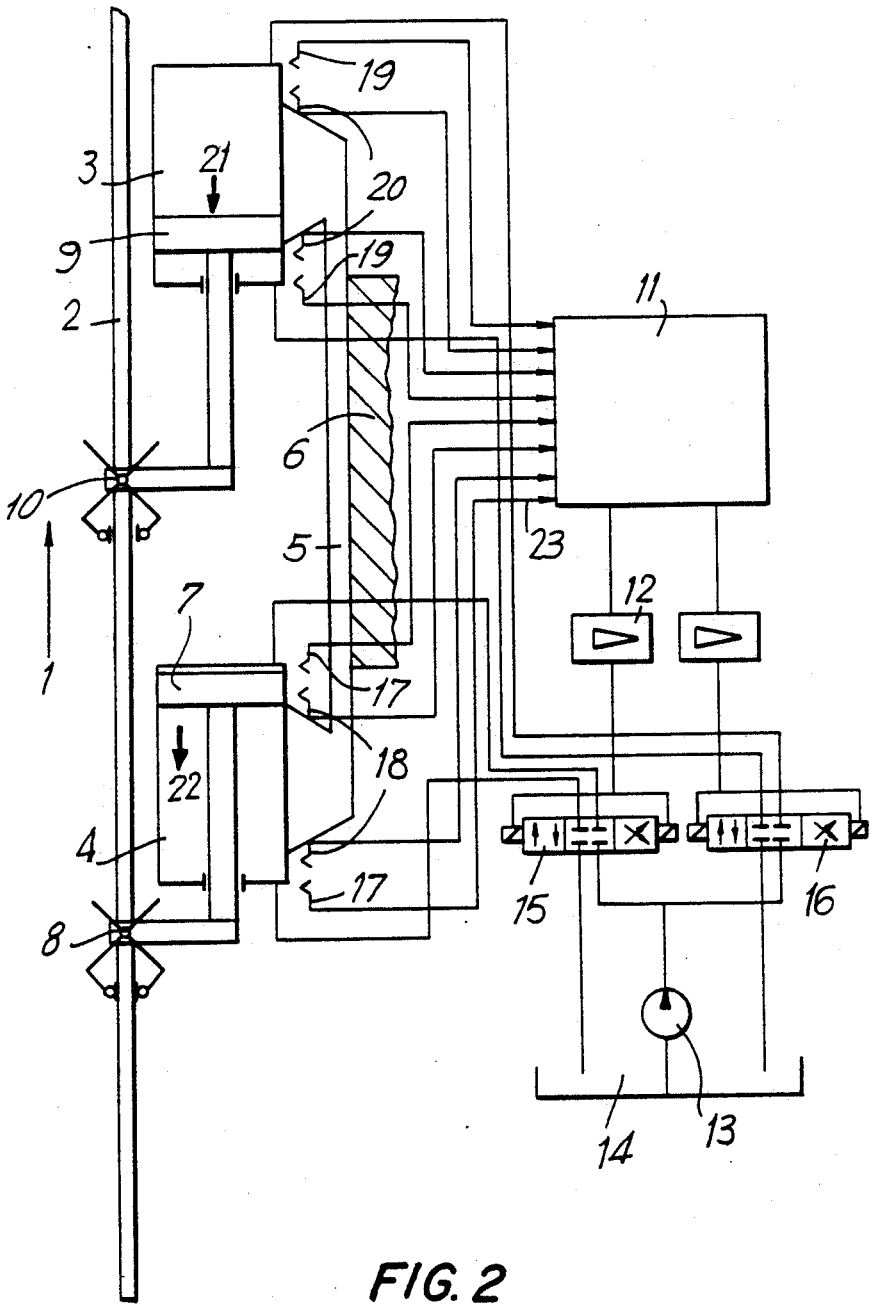
FIGS. 2–4 are views showing various phases of individual movements and conditions of the arrangement of FIG. 1.

In FIG. 2 the piston 9 reaches the end position pre-signal sensor 20, which after the signal processing sets the piston 7 of the cylinder 4 of the second cylinder-piston unit in movement direction 22 and simultaneously the clamping mechanism 8 engages with the load receiving element 2.

Figure 3:
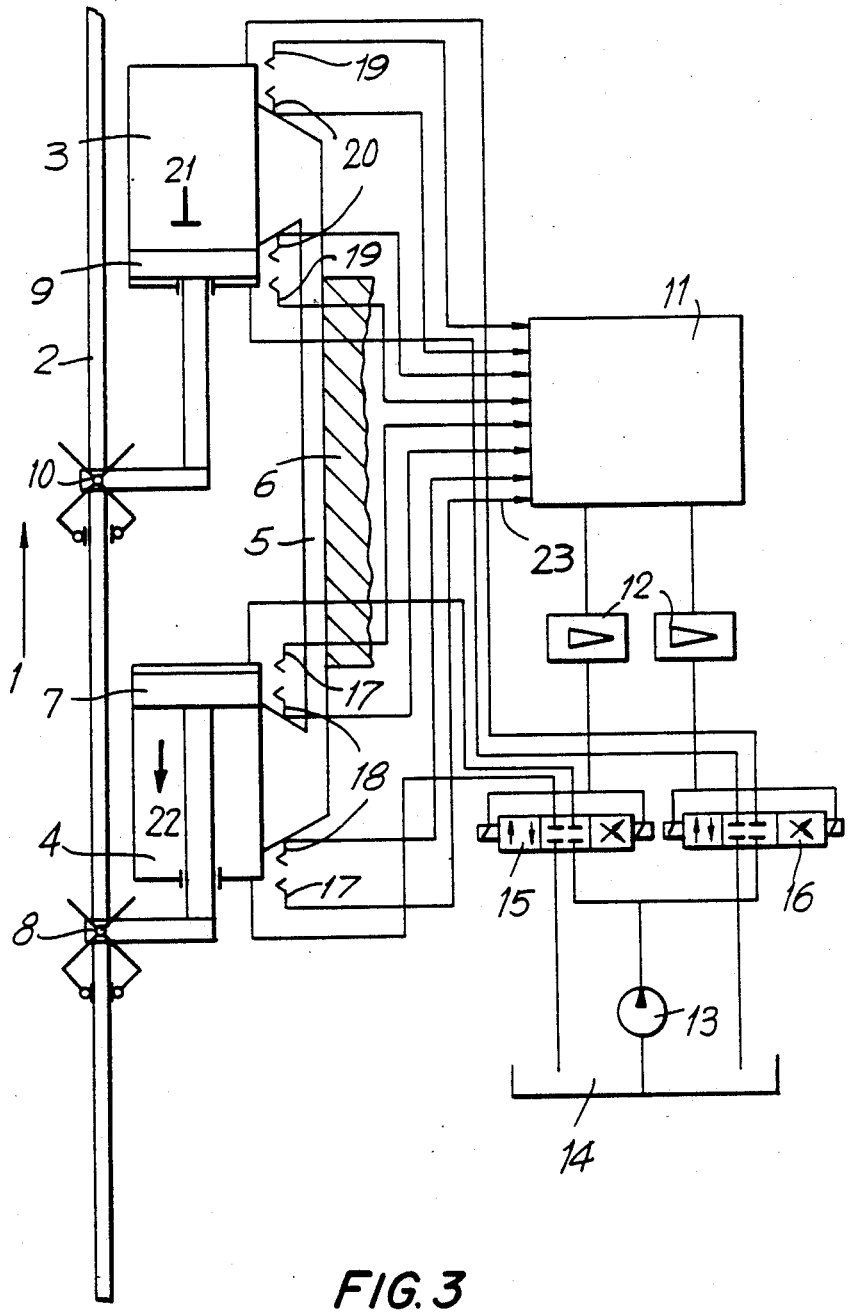

In FIG. 3 the piston 9 is shown in the end position. The clamping mechanism 10 is opened, the piston 7 is in movement and performs a load stroke from the movement direction 22.

Figure 4:
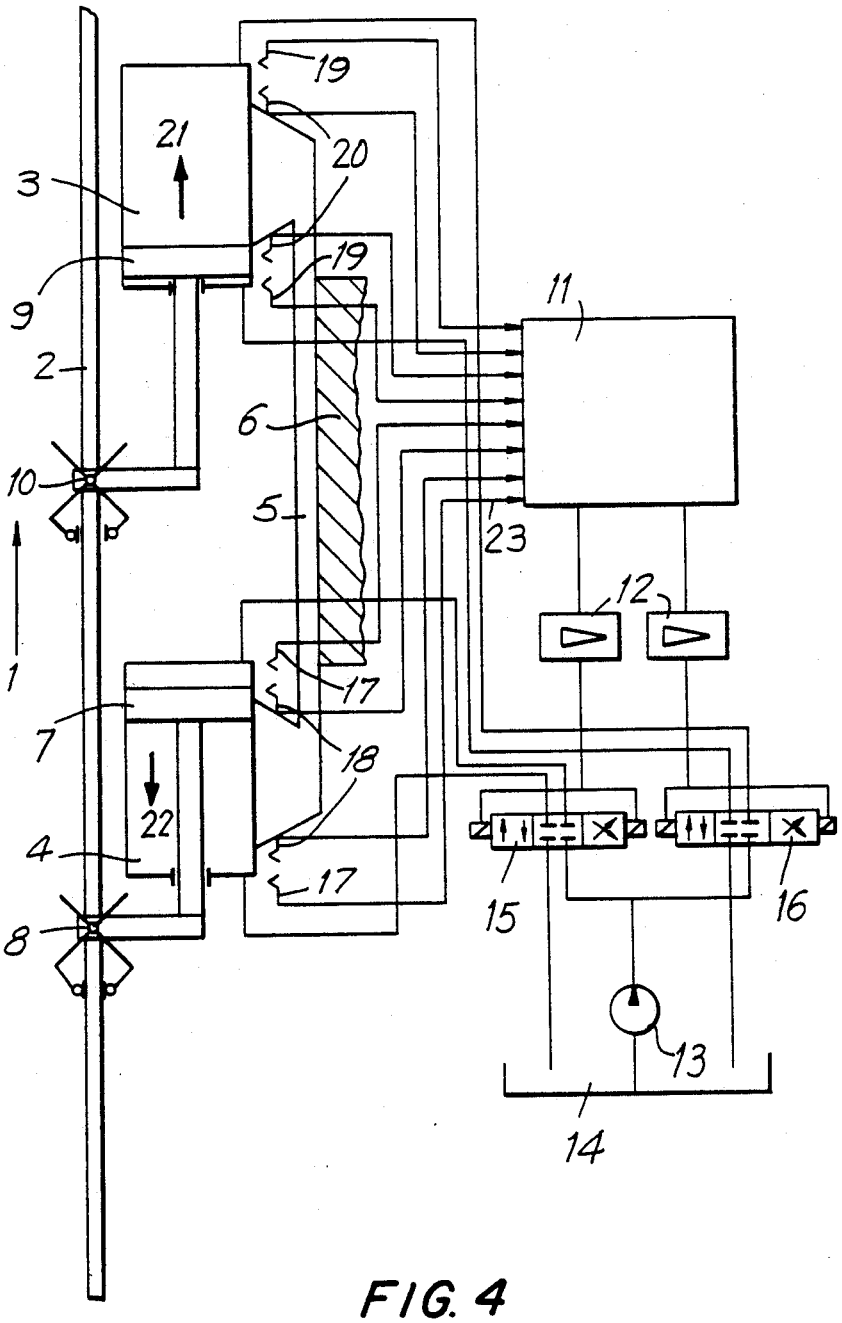

With reaching the end position pre-signal sensor 18 in FIG. 4, by the piston 7, the piston 9 of the cylinder 3 of the first cylinder-piston unit is set in movement for an unload stroke in the movement direction 21. Upon reaching the outer end position the same cycle is performed, and the functions of the first cylinder-piston unit, the piston 9 and the clamping mechanism 10 are now taken by the second cylinder-piston unit for the piston 7 and the clamping mechanism 8.

When the arrangement is provided with several cylinder-piston units with several cylinders which are mechanically coupled with one another and with pistons performing unload and load strokes, with a common clamping mechanism, the signal of the individual end position sensor of the individual piston which performs the unload stroke is used for activating the movable position of the same and the signal of the end position pre-signal sensor of the last piston in the load stroke which reaches this position is used for processing and conducting the new load stroke.

The signal of the end position sensor of the last piston which previously stood under load displaces it in a movable position and opens the clamping mechanism, and the signal of the end position pre-signal sensor of the last piston which is newly located under load initiates the unload stroke.

In accordance with a further embodiment of the invention, all displacement cylinder-piston units can have a joint sensor each provided for a respective position.

When in a translation direction 1 two arrangements are located with the use of a rope as a load receiving element 2 in horizontal translation movement, then first an opposite working direction of the partial system is achieved by the tensioning of the rope, before performing the translation movement in the predetermined direction.

It will be understood that each of the elements described above, or two or more together, may also find a useful application in other types of constructions differing from the types described above.

While the invention has been illustrated and described as embodied in an arrangement for converting a stepwise translation movement into a continuous translation movement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for converting a stepwise translation movement into a continuous translation movement, comprising at least two fluid-operated cylinder-piston units having cylinders which are rigidly mechanically connected with one another, pistons movable in said cylinders between end positions, and piston rods connected with said pistons; at least two clamping mechanisms each releasably arranged on said piston rod of a respective one of said cylinder-piston units; two end position sensors arranged in the regions of said end positions of said piston of each of said cylinder-piston units; and two end position pre-signal sensors which are axially offset from said end position sensors; electronic control means connected with said sensors and producing signals which are supplied to said cylinder-piston units so that said pistons are supplied with a working fluid in an alternating order.

2. A method for converting a stepwise translation movement into a continuous translation movement, comprising the steps of providing at least two fluid-operated cylinder-piston units with cylinders which are rigidly mechanically connected with one another and pistons movable in said cylinders between end positions and having piston rods; removably arranging clamping mechanisms on said pistons of said cylinder-piston units; arranging end position sensors in the regions of said end positions of said piston of a respective one of said cylinder-piston units; arranging end position pre-signal sensors so that they are axially spaced relative to said end position sensors; connecting said sensors with electronic control means so that signals produced by said electronic control means control a working fluid to said cylinders of said cylinder-piston units in an alternating manner.

3. An arrangement as defined in claim 1, wherein said cylinder-piston units are hydraulically operated cylinder-piston units.

4. An arrangement as defined in claim 1, wherein said cylinder-piston units are pneumatically operated cylinder-piston units.

5. An arrangement as defined in claim 1; and further comprising directional valves arranged so that said signals of said electronic control means are supplied to said cylinder-piston units through said directional valves.

6. An arrangement as defined in claim 1; and further comprising a further such fluid-actuated cylinder-piston unit.

7. A method as defined in claim 2, wherein said steps of producing and supplying includes supplying the working fluid so that said cylinder-piston units operate parallel in time so that when said piston of one of said cylinder-piston units in which said piston rod carries said clamping mechanism which engages with a load receiving element performs a load stroke, the piston of the other of said cylinder-piston units performs an unload stroke which is faster than said load stroke, and the signals of said end position pre-signal sensors and end position sensors are processed in said electronic control means so that the piston which performs a load stroke upon reaching of respective end position remains in it until the piston which previously performs a load stroke reaches the end position pre-signal signal sensor of its desired end position, the clamping mechanism of the piston located in immovable condition is brought in engagement and set in movement for a new load stroke, while the piston which previously performs the load stroke releases the clamping mechanism upon reaching the end position sensor and a stroke direction is reversed for a new unload stroke when the piston which performs the new load stroke passes the end position pre-signal sensor of the previous end position.

8. An arrangement as defined in claim 5, wherein said directional valves are hydraulic directional valves.

9. An arrangement as defined in claim 5, wherein said directional valves are pneumatic directional valves.

10. A method as defined in claim 9, wherein said step of providing includes providing a further such cylinder-piston unit with a cylinder which is mechanically coupled with said cylinders of said first-mentioned cylinder-piston units and with a piston which is movable in said cylinder of said additional cylinder-piston unit and provided with a piston rod carrying a clamping mechanism.

* * * * *